United States Patent [19]

Cassinelli

[11] Patent Number: 4,487,546

[45] Date of Patent: Dec. 11, 1984

[54] DEVICE FOR TRANSFERRING TUBULAR FABRICS FROM SUPPORT HANGERS TO A RIGID BODY AND INVERTING THE FABRIC

[75] Inventor: Giuseppe Cassinelli, Varese, Italy

[73] Assignee: Savio & C. S.p.A., Milan, Italy

[21] Appl. No.: 398,443

[22] Filed: Jul. 14, 1982

[30] Foreign Application Priority Data

Aug. 5, 1981 [IT] Italy ..... 23382 A/81

[51] Int. Cl.[3] ..... A41B 11/00

[52] U.S. Cl. ..... 414/751; 294/97; 223/41; 223/112

[58] Field of Search ..... 414/783, 751, 753, 754; 223/41, 74, 77, 112; 294/97

[56] References Cited

U.S. PATENT DOCUMENTS

| | | | |
|---|---|---|---|
| 1,771,521 | 7/1930 | Baum | 223/41 |
| 2,864,539 | 12/1958 | Parrilla | 223/41 |
| 3,951,400 | 4/1976 | Blessing et al. | 414/751 X |
| 4,375,267 | 3/1983 | Giovanni et al. | 223/112 |
| 4,392,596 | 7/1983 | Painter | 223/77 X |

*Primary Examiner*—Robert J. Spar
*Assistant Examiner*—Terrance L. Siemens
*Attorney, Agent, or Firm*—Oblon, Fisher, Spivak, McClelland & Maier

[57] ABSTRACT

A device for transferring tubular fabrics, particularly panty hose, the opening or mouth of which is fitted on support hangers which are spaced apart from one another and hold the mouth at an open position, and for transferring such tubular fabrics onto a rigid body adjacent to and aligned with the hangers by inverting the tubular fabrics on such rigid body. The device includes a slide longitudinally movable on a fixed guide, jaws mounted on the slide and includes four discrete rotable elements in two pairs on two discrete planes, a pan projecting forwardly of the slide and freely axially movable relative thereto against the action of a spring, plungers supported from the jaws which project for insertion in the mouth or opening of the tubular fabric as the slide moves forward, followed by lifting such fabric out of the support hangers when the jaws are spread out. The jaws then provide for laying the tubular fabric onto said rigid body, after the pan has pressed by spring action the panty hose horse on the free end of the rigid body on which the panty hose is laid in an inverted position, when the plungers are withdrawn relative to the respective jaws.

3 Claims, 6 Drawing Figures

DEVICE FOR TRANSFERRING TUBULAR FABRICS FROM SUPPORT HANGERS TO A RIGID BODY AND INVERTING THE FABRIC

BACKGROUND OF THE INVENTION

1. Field of the Invention

This invention relates to a device for drawing tubular fabrics, particularly panty hose, the opening or mouth of which is fitted on support hangers, which are spaced apart from one another and hold such mouth at an open position, the fabrics then being inverted on a rigid body.

2. Description of the Prior Art

It is well known that the need sometimes occurs of transferring tubular fabrics from support hangers on which the fabrics have been processed or treated to other support bodies, on which said tubular fabrics are successively further processed or treated.

For example, it is well known that machines have been developed as provided with hangers on which two elements of tubular fabric comprising the legs of a pair of panty hose are manually mounted, such machines then automatically providing for carrying out a series of processes or treatments on the tubular fabric elements, seaming the latter to one anther, so that at the machine outlet the pairs of rigid hangers, forming part of the machine, support a complete pair of panty hose, the mouth of which is open and taut on each pair of hangers after completion of the automatic sewing operations for the two legs of the pair of panty hose. A machine of such design is described, for example, in the German Pat. No. 2,434,941.

Machines are also known of an automatic type and provided with rigid cylinders or bodies on which the panty hose obtained by the first mentioned machine are manually mounted, such panty hose being mounted in an inverted position on each cylinder, on which they are blocked or clamped by automatic mechanical gripping members. Thereupon, and still automatically, the inside (in this case comprising the outwardly facing surface of each pair of panty hose) has applied thereto a small reinforcement block or insert piece which is then automatically sewn to the panty hose. A machine of such a design is described in the British Pat. No. 2,001,238A.

A panty hose obtained by the automatic sewing machine is manually drawn, transferred and inverted on the support cylinders of the automatic block or insertion applying machine. This is a serious drawback, since the manual operations are highly expensive and slow down the output rate of the machines, which could be even higher than presently required.

SUMMARY OF THE INVENTION

It is the primary object of the present invention to provide an automatic device by which tubular bodies mounted on support hangers can be drawn at a very high rate or speed and then transferred through inversion operation to further support bodies, the latter being aligned with said hangers.

More particularly, it is the object of the present invention to provide a device by which the panty hose sewn on an automatic machine can be automatically moved, transferring such articles to the support cylinders of a machine, by inversion, thereof on such cylinders, the machine automatically applying and sewing thereon a reinforcement block or insert at the panty hose horse.

It is a still further object of the invention to provide a device of the above mentioned design which is of quite simple structure, is reliable in operation, and is readily applicable to known type of machines presently in use.

These and still further objects are achieved by a device for transferring tubular fabrics carried by support hangers and transferring such fabrics by inversion thereof on a rigid body, comprising a slide longitudinally movable on fixed guides, ensuring movement thereof to and between said support hangers and up to the free end of said rigid body and vice versa, jaws comprising at least four discrete elements hinged on said slide and interconnected by kinematic means for rotation between a position at which such elements are moved near one another, and a position at which said elements are spread apart, stems carried by each of the pliers elements, drive members for causing the slide to move in either direction between a position at which said jaws are remote from said support hangers for the tubular fabric and said rigid body, and a position at which said jaws act upon the edge of an opening provided by said tubular fabric, and drive members for generating movement of said jaws.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
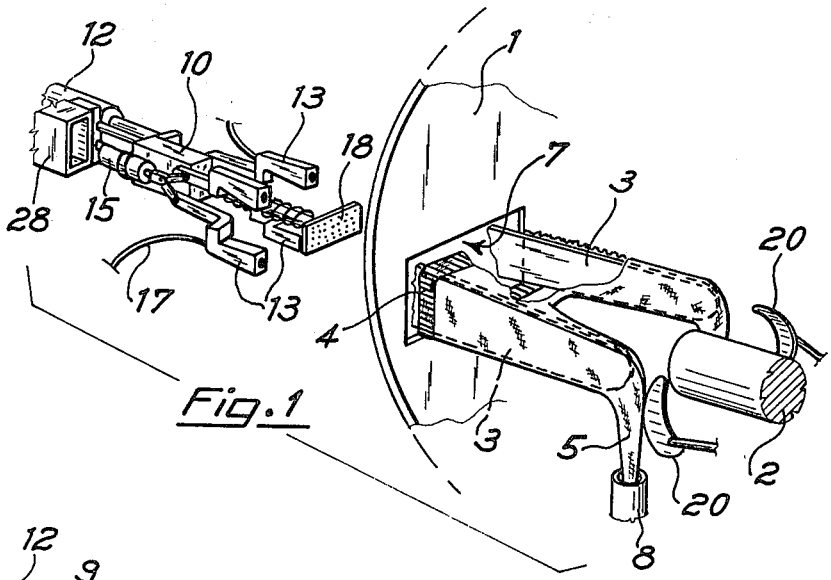
FIG. 1 is a schematic perspective view showing the assembly comprising the device and two opposite portions of a panty hose sewing machine and a machine for automatically applying a reinforcement block or insert on such panty hose.

First referring to FIG. 1, there is shown in this figure a portion 1 of a known type of machine for automatically sewing two tubular fabrics to form a pair of panty hose, and a cylinder 2 forming part of a machine, also of known type, for automatically applying and sewing a reinforcement block or insert on the pair of panty hose.

The above mentioned first machine comprises two rigid metal hangers 3, on which the mouth or opening of a pair of panty hose is overlayed and stretched out, the free edge of such mouth or waist of the panty hose being denoted by reference numeral 4, while the legs of the panty hose are denoted by reference numeral 5 and the panty hose horse by reference numeral 6. The two hangers 3 are mounted at an opening 7 of the first machine, and these hangers are movable with respect to each other in any known manner.

Below the free ends of legs 5, two tubes 8 are positioned (of which tubes only one is shown in the drawing) which are connected to a suction source for pulling the free ends of the two legs 5 of each pair of panty hose downward and thus keeping the entire pair of panty hose stretched out on the two hangers 3.

On the sewing machine 1 provision is made for a plurality of pairs of hangers 3 which are subsequently moved to the position shown in the drawing.

At said position, and just in front of the pair of hangers 3 then involved, there is positioned the rigid body or cylinder 2 of the automatic machine designed to automatically sew the block or insert on the panty hose, as will be further discussed hereinafter.

Still on the same line of cylinder 2 and the pair of hangers 3, the transfer device according to the present invention is provided, which device comprises a rigid guide comprising a metal beam 28 having guide rods 9 extending therefrom, the guide rods carrying a slide member 10 connected to the stem 11 of a piston movable within a pneumatic or oleodynamic cylinder 12 carried by said beam 28.

The slide carries jaws comprising four discrete elements, all of which denoted by reference numeral 13, which are keyed two by two on two pins or axes parallel with each other and supported by the slide, as clearly shown in FIGS. 2 through 6. Through small connecting rods 14, said jaws 13 are connected to the stem of a piston which is accomodated and movable within a pneumatic or hydraulic cylinder 15 carried by said slide 10. It clearly appears that the movement of the stem projecting from cylinder 15 causes the jaws to be widened out or retracted upon rotation of the jaws 13, two on one plane and two on a different plane parallel with the former.

The end portions of the jaws 13 are internally hollow and accomodate therein stems 16 (FIGS. 3 through 6) which are movable so as not to project beyond the free edge of jaws 13 (FIGS. 1 and 2) or project therefrom (FIGS. 3 through 6). Of course, the projection or retraction movement of the stems within said jaws 13 can be obtained in any known manner, and for the sake of simplicity they are shown in the drawing as comprising the stems of four pistons movable against the action of a return spring (not shown) within cylindrical chambers in the elements, the projection movement of the stems being caused by the supply of compressed air through hoses 17 (of which only two have been shown in the drawings for illustration simplicity and for unnecessarily complicating the drawings).

The device further comprises a pan 18 which is integral with a stem 19 freely movable within a suitable seat in the slide, a spring 20 reacting between said pan and slide as wound up about stem 19 and tending to retain said pan so as to be urged rightwardly, as seen in the drawings.

Figure 2:
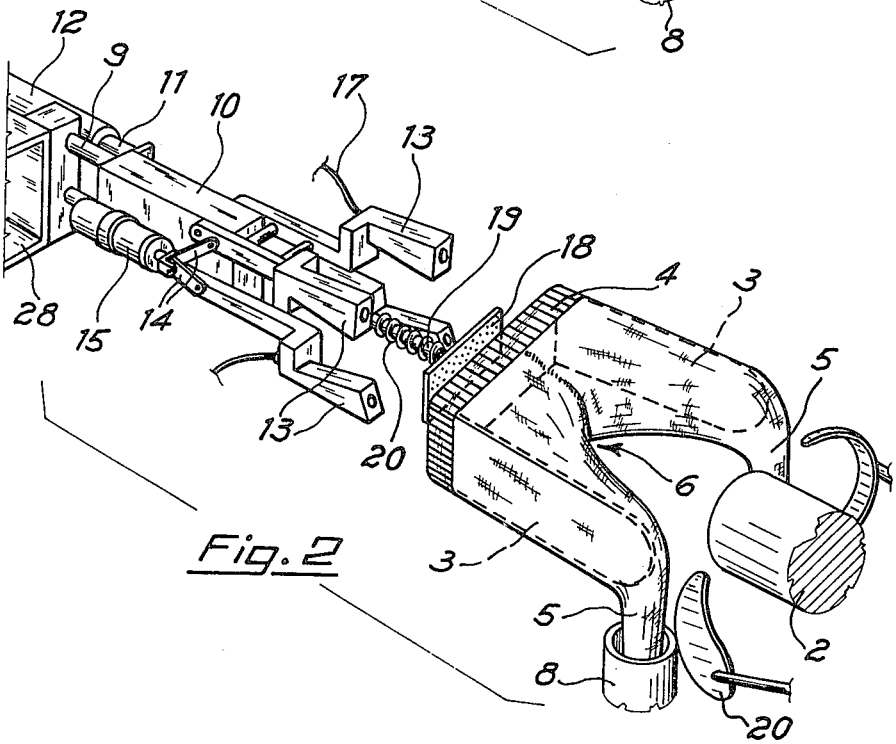
FIG. 2 is an enlarged perspective view of an assembly similar to that of FIG. 1, at a step just prior to the device operation.

Assuming now that the conditions are those shown in FIGS. 1 and 2, where the device is at rest or inoperative positions and coaxially with and positioned in front of the device are the pair of rigid hangers 3, the hangers being part of the sewing machine and wherein the cylinder 2 of a machine for automatically applying a block or insert on said pair of panty hose is used.

Figure 3:
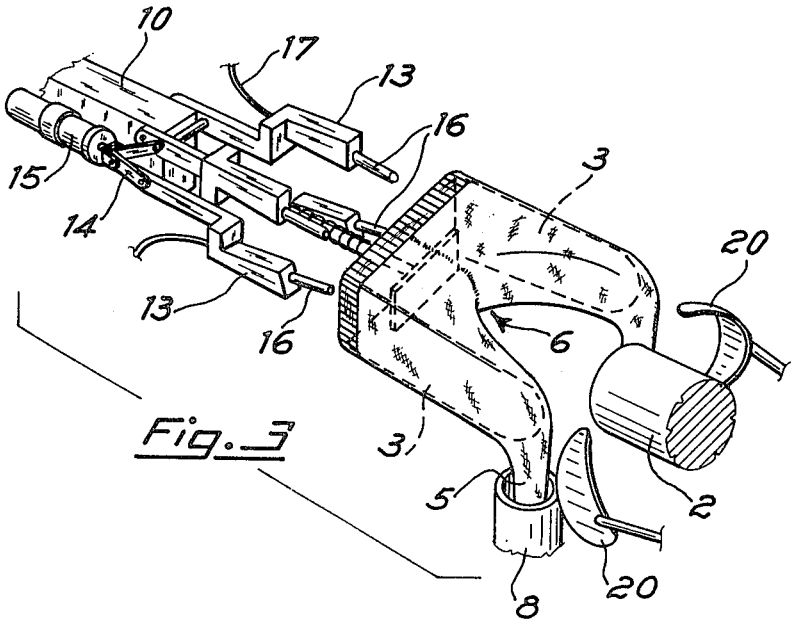
FIGS. 3 and 4 are two perspective views of the device, shown at two successive stages of its operation, when moving near the pair of panty hose carried on the hangers of the machine that has provided for sewing, and when starting to act on the panty hose.

Under these conditions, said hangers 3 are spread apart from each other and hold the mouth or opening of the panty hose open and taut, just as shown in FIG. 1. The representation of machine portion 1 of the device has been omitted in FIG. 2 for the sake of clarity. Therefore, from the conditions of FIGS. 1 and 2, when the device is operated, compressed air is supplied to the pneumatic cylinder 12, thus causing rightward movement of slide 10 along with all the parts carried thereby. During the first stage of movement for slide 10, pan 18 initially enters the mouth or opening (FIG. 3) of the panty hose, while the free ends of the jaws 13 move close to the waist 4. During this first movement stage, the control or drive is provided for the projection of stems 16 from the respective seats of jaws 13, as shown in FIG. 3.

Figure 4:
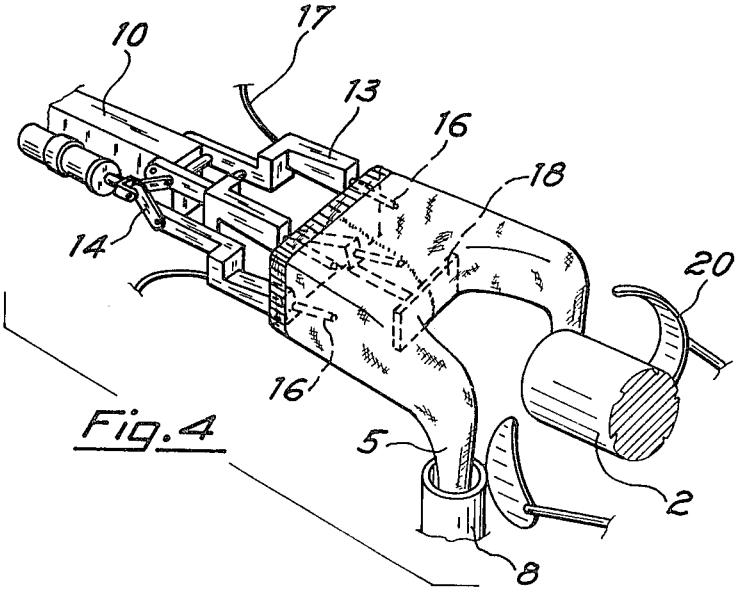

Upon continued rightward movement of the slide 10, said stems 16 enter the periphery defined by edge 4 of the opening or mouth of the panty hose, while pan 18 moves adjacent to and in contact with the panty hose horse 6 (FIG. 4).

Figure 5:
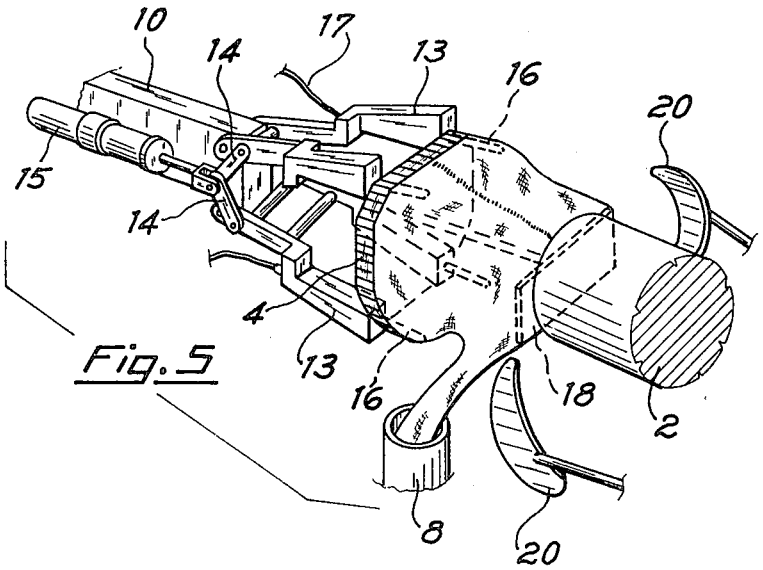
FIG. 5 is a view showing the device at the beginning of the transfer step for a pair of panty hose from the support hangers to the rigid cylinder of the machine on which a reinforcement block or insert will be applied thereto.
Figure 6:
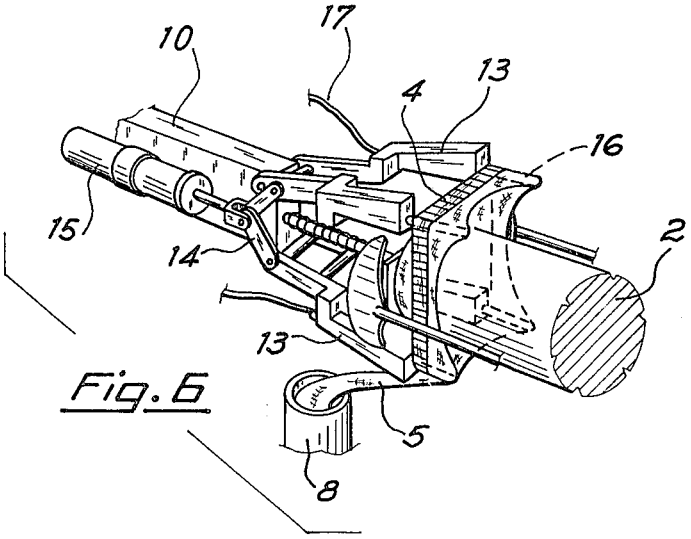
FIG. 6 is a view showing the device at the final step of transfer operation for the panty hose and inversion thereof on the machine cylinder for block or insert application within the panty hose.

The movement is of slide 10 continued, while pan 18 moves the horse 6 against the free end of cylinder 2, aligned with and facing thereto, and compressed air is supplied to cylinder 15, the stem of which projects therefrom and causes the rigid jaws 13 to be spread apart, as shown in FIG. 5. Thus, stems 16 lift the free edge of the panty hose away from the support hangers 3 (which, for clarity, have not been shown in FIGS. 5 and 6). Now, continued rightward movement of the slide 10 provides for lifting the panty hose away from the pair of hangers previously carried thereby, and transferring of the opening or mouth of the panty hose to the cylinder 2 shown in the drawings until, insofar as the horse 6*i*, blocked against the free end of cylinder 2 by pan 18, said opening or mouth and the waist portion of the panty hose are superimposed and inverted on the cylinder, as shown in FIG. 6.

Now, stems 16 re-enter the respective seats of jaws 13 that had forwardly urged the edge 4 of the panty hose, so that the waist portion and free edge of the panty hose are positioned above cylinder 2, in an inverted position relative to that taken above hangers 3. The device is now returned to the rest or inoperative position shown in FIGS. 1 and 2, by reverse movements of those elements above described.

As soon as the inverted panty hose is positioned above cylinder 2, it is automatically blocked thereon by automatic jaws 20 forming part of the machine designed for automatically applying and sewing a reinforcement block or insert at the panty hose horse, which machine as above mentioned is a well known type and accordingly not described herein.

From the foregoing it will clearly appear that operation of the device is fully automatic, of maximum simplicity and has an extremely high operating speed, enabling complete automation of all of those operations at present requiring a long time to complete and large amount of personnel.

It should be understood that the members controlling the movements of the movable parts comprising the device could be implemented differently than shown in the drawings and herein described, provided that the same object and functionality is obtained in the automatic device for transferring textile tubular fabrics, as has been shown.

The device as above described and depicted in the accompanying drawings has shown to be perfectly functional and suitable to achieve the desired objects. However, it should be pointed out that some parts of the device could be modified without departing from the scope of the present invention. For example, instead of being movable on the relative jaws 13, said stems 16 could be fixed on said elements, while pan 18 with its stem 19 and spring 20 could be eliminated, the device being also in this case effective in transferring and inversion the tubular fabrics on a rigid body, such as that herein described.

Finally, it is important to point out that, in the exemplary embodiment shown, the case was described in which said stems 16 insert in the opening defined by a waist portion of the panty hose. However, it should be apparent that the opening, in which said stems are inserted, could be other than the waist, for example comprising the edge of a hole at the panty hose horse, where a reinforcement block or insert has to be then sewn, after the panty hose are transferred to and inverted on rigid body 2.

What I claim is:

1. A device for shifting tubular fabric carried by support hangers and transfering the same by inversion thereof on a rigid body, the device comprising:

a longitudinally movable slide mounted on fixed guides for generating movement toward and away from said support hangers and toward and away from said rigid body;

a plurality of jaw members including at least four elements hinged on said slide;

means interconnecting said elements for generating rotation of said elements between a position at which such elements are proximate one another and a position at which said elements are spread apart, each of said elements having a stem mounted thereon; and control means for moving said slide in a forward or reverse direction between the position at which said elements are remote from said support hangers and said rigid body and a position at which said elements act upon an edge of an opening formed in said tubular fabric and for moving said elements.

2. A device according to claim 1, wherein said control means further comprises first and second units operated so that said slide is first moved forward with said jaws closed to said opening, said stems then being inserted within said opening and, as forward movement of said slide continues, said jaws being spread apart, thus providing a combined movement causing the stems to lift an edge of said opening and invert said tubular fabric over an end portion of said rigid body upon continuation of movement of said slide.

3. A device according to claim 1, further comprising a pan member mounted on said slide and spring means, mounted on said slide for biasing said pan member away from said slide, said pan being resiliently pressed against said rigid body immediately prior to said elements acting upon said opening in said tubular fabric.

* * * * *